United States Patent [19]

Eichler et al.

[11] 4,432,280

[45] Feb. 21, 1984

[54] CONTROL SYSTEM FOR SHEET-FED MULTI-COLOR ROTARY PRINTING MACHINES

[75] Inventors: Volker Eichler, Weinbohla; Hilmar Trinks, Radebeul, both of German Democratic Rep.

[73] Assignee: Veb Kombinat Polygraph "Werner Lamberz" Leipzig, Leipzig, German Democratic Rep.

[21] Appl. No.: 393,356

[22] Filed: Jun. 29, 1982

[30] Foreign Application Priority Data

Jun. 30, 1981 [DD] German Democratic Rep. ... 231299

[51] Int. Cl.[3] ..... B41F 5/02

[52] U.S. Cl. ..... 101/230

[58] Field of Search ..... 101/230, 231, 247, 232, 101/229, 183, 136, 137; 271/291, DIG. 9

[56] References Cited

U.S. PATENT DOCUMENTS 3,946,669 3/1976 Johne ..... 101/230

4,147,105 4/1979 Becker ..... 101/230

*Primary Examiner*—J. Reed Fisher

*Attorney, Agent, or Firm*—Michael J. Striker

[57] ABSTRACT

A control system for adjusting functional elements of consecutive printing units of a multi-color, sheet-fed, rotary printing machine during its changeover from a first or face printing mode of operation to the first and second or back-up printing mode of operation. The system includes a first control circuit fed with data signals and clock pulse signals for controlling functional elements of a first printing unit, and a second control circuit for controlling functional elements of the subsequent printing unit. An auxiliary control circuit is arranged between the two control circuits and cooperates with a timing pulse adjuster which in turn is controlled by timing pulses from a timing pulse generator, from a sheet-control device and from a machine stop detecting device. The auxiliary control circuit is controlled by comparison pulses from the timing pulse generator and from a signal delivered by a switching unit activated simultaneously with the changeover from the first printing to the first and second printing mode of operation of the printing machine.

3 Claims, 3 Drawing Figures

CONTROL SYSTEM FOR SHEET-FED MULTI-COLOR ROTARY PRINTING MACHINES

BACKGROUND OF THE INVENTION

The present invention relates in general to sheet-fed, multi-color, rotary printing machines including a plurality of printing units provided with sheet-turning devices therebetween. In particular, this invention relates to a control system for printing machines of this kind for changing over a first or face printing to the first and second or back-up printing.

In the DD Pat. No. 94 400, a control system for multi-color printing machines of this kind is described, which consists of a plurality of interconnected control systems assigned to respective printing units of the machine. During the first or face printing mode of operation, the control device produces a synchronization of the starting command with each rotation and with the phase in the rotation at which the start or introductory command in the corresponding unit is to be executed. In the first printing mode of operation, the assignment of a definite rotation and of a definite phase to corresponding initiating commands is constant and, depending on the geometry of the printing machine. The initiating commands activate an interrogating stage which is responsive to the signal exchange in the assigned control device for the printing unit and controls groups of functional elements in this printing unit.

In the first- and second (back-up) printing mode of operation, in which the sheets are turned over so that it is their trailing edge which is first transferred to the next printing unit and not their leading edge, and the aforementioned constant assignment or coordination of the sheets relative to the angular positions of the cylinders is no longer present. Instead, there is a constant phase shift in the movement of the sheets. Moreover, there is also a variable phase shift resulting from the different formats of the processed sheets. In order to compensate for these phase shifts, the prior-art control device includes an auxiliary control device cooperating with a timing pulse generator. The auxiliary control device is activated via a switching device and via the timing device, which in turn is responsive to the changeover from the first printing to the first and second printing mode of operation.

The disadvantage of this prior-art arrangement is the fact that it is necessary to control auxiliary control device by means of the timing pulse generator, which in turn is dependent on the changeover from the first printing to the first and second printing, and is arranged on a printing unit after its sheet-turning device. This auxiliary control device is arranged outside a central control station, in order to ensure the desired adjustment.

SUMMARY OF THE INVENTION

It is therefore a general object of the present invention to overcome the aforementioned disadvantages.

More particularly, it is an object of the invention to provide an improved control system for multi-color printing machines of the above-described type, capable of changing first or face mode of printing machine operation to the first and second or back-up printing mode of operation, which is simpler in structure than the prior-art control devices of this type.

An additional object of the invention is to provide such an improved control system, in which the timing pulse generator adjustable by the changeover from the first printing to the first and second printing mode of operation of the machine, is not decentralized but is arranged in the central control station.

In keeping with these objects, and others which will become apparent hereafter, one feature of the invention resides, in a multi-color printing machine of the aforedescribed kind, in the provision of a first control circuit for controlling a printing unit, said control circuit including a data input, a data output, a clock pulse input and a clock pulse output; an auxiliary control circuit having a plurality of inputs and two outputs, said clock pulse output of the first control circuit being connected to one input of said auxiliary control circuit; a switching device responsive to the changeover of the printing machine from the first printing mode of operation to the first and second printing mode of operation, said switching device being connected to another input of said auxiliary control circuit; a second control circuit having a data input and a clock pulse input connected respectively to the outputs of said auxiliary control circuit; a timing pulse adjuster connected between said auxiliary control circuit and said timing pulse generator; a control circuit arranged on the sheet-turning device and having its output connected to another input of said auxiliary control circuit and said timing adjuster; and said timing pulse generator being connected to a fourth input of said auxiliary control circuit.

The auxiliary control device includes four AND-gates having first inputs connected parallel and controlled by the switching device, and second inputs connected respectively to the clock pulse output of the first control circuit, to the sheet control device, to the timing pulse adjuster, and to the timing pulse generator. The outputs of the AND-gates are connected in pairs to two OR-gates and the outputs of the latter are connected to the second control circuit.

The timing pulse adjuster is a logic circuit composed of a plurality of groups of storing devices connected via an AND-gate to the sheet control device and having a resetting input connected to a device for stopping the printing machine. The outputs of respective storing devices are connected through a combination of AND-gates and OR-gates to the auxiliary control circuit, whereas the inputs of the AND-gates are connected to the timing pulse generator.

The novel features which are considered characteristic for the invention are set forth in particular in the appended claims. The invention itself, however, both as to its construction and its method of operation, together with additional objects and advantages thereof, will best be understood from the following description of specific embodiments when read in connection with the accompanying drawing.

DESCRIPTION OF THE PREFERRED EMBODIMENT

Figure 1:
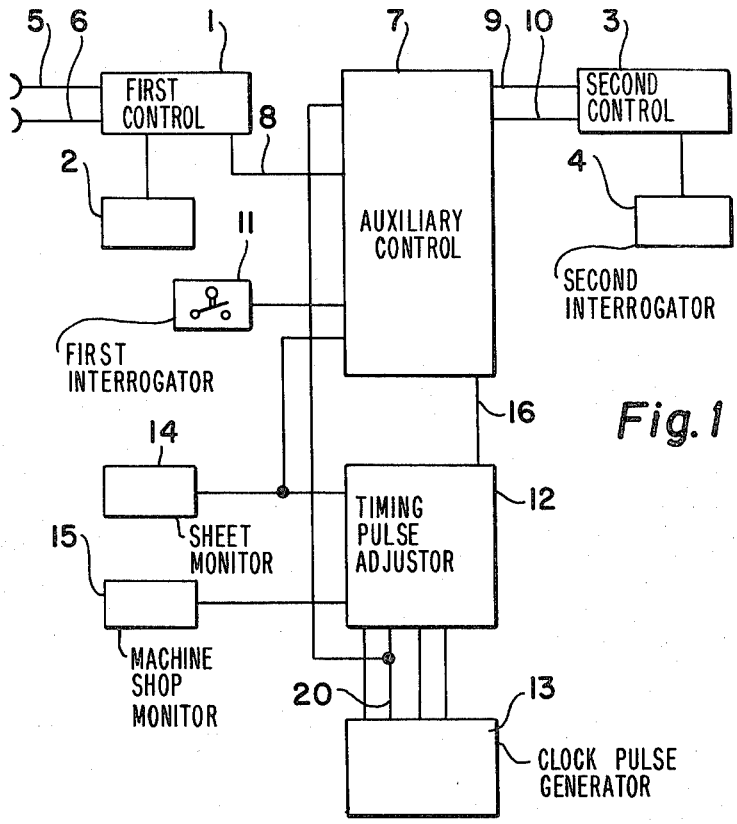
FIG. 1 is a schematic block diagram of the control system according to this invention.

The control system illustrated schematically in FIG. 1 is arranged in a central control station of a non-illustrated sheet-fed, multi-color rotary printing machine which is constituted by a plurality of printing units, whereby between two consecutive printing units a sheet-turning device is provided. The control system of this invention serves for activating in a correct functional sequence the groups of functional elements of respective printing units, both in the first printing mode of operation and in first printing and second printing mode of operation.

Figure 2:
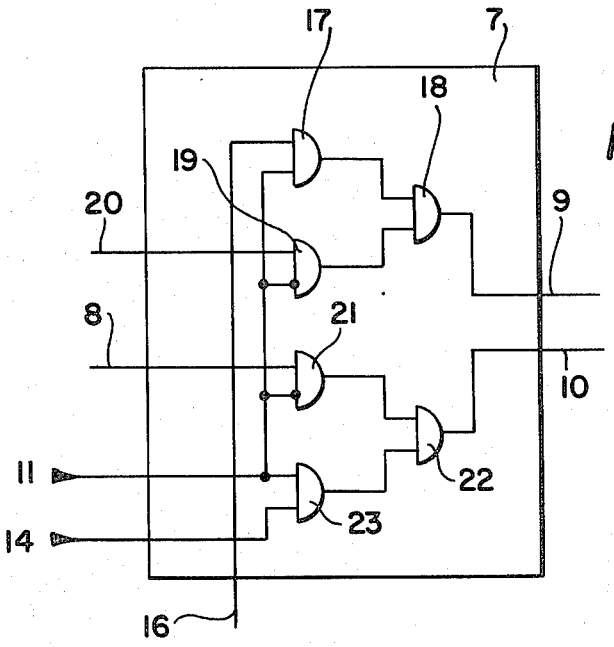
FIG. 2 is a schematic circuit diagram of the auxiliary control circuit.

The control system includes a first control circuit 1 having a clock pulse input 5 and a data input 6 and controlling a first interrogating circuit 2, which in turn activates in proper sequence the functional groups of the first printing unit. A second control circuit 3 cooperates with a second interrogating circuit 4 which controls the functional groups of the subsequent printing unit. The control system further includes an auxiliary control device 7 which is constituted by the combination of AND-gates 17 and 23, NAND-gates 19 and 21 and OR-gates 18 and 22, as illustrated in FIG. 2. An input of the AND-gate 21 is connected to the data output 8 of the first control circuit 1, whereas the output of OR-gate 18 is connected to the clock pulse input 9, and the output of the second OR-gate 22 is connected to the data input 10 of the second control stage 3. The input of the AND-gate 23 is connected to a switching device 11 activated in response to the changeover of the printing machine from the first printing to the first and second printing mode of operation.

Figure 3:
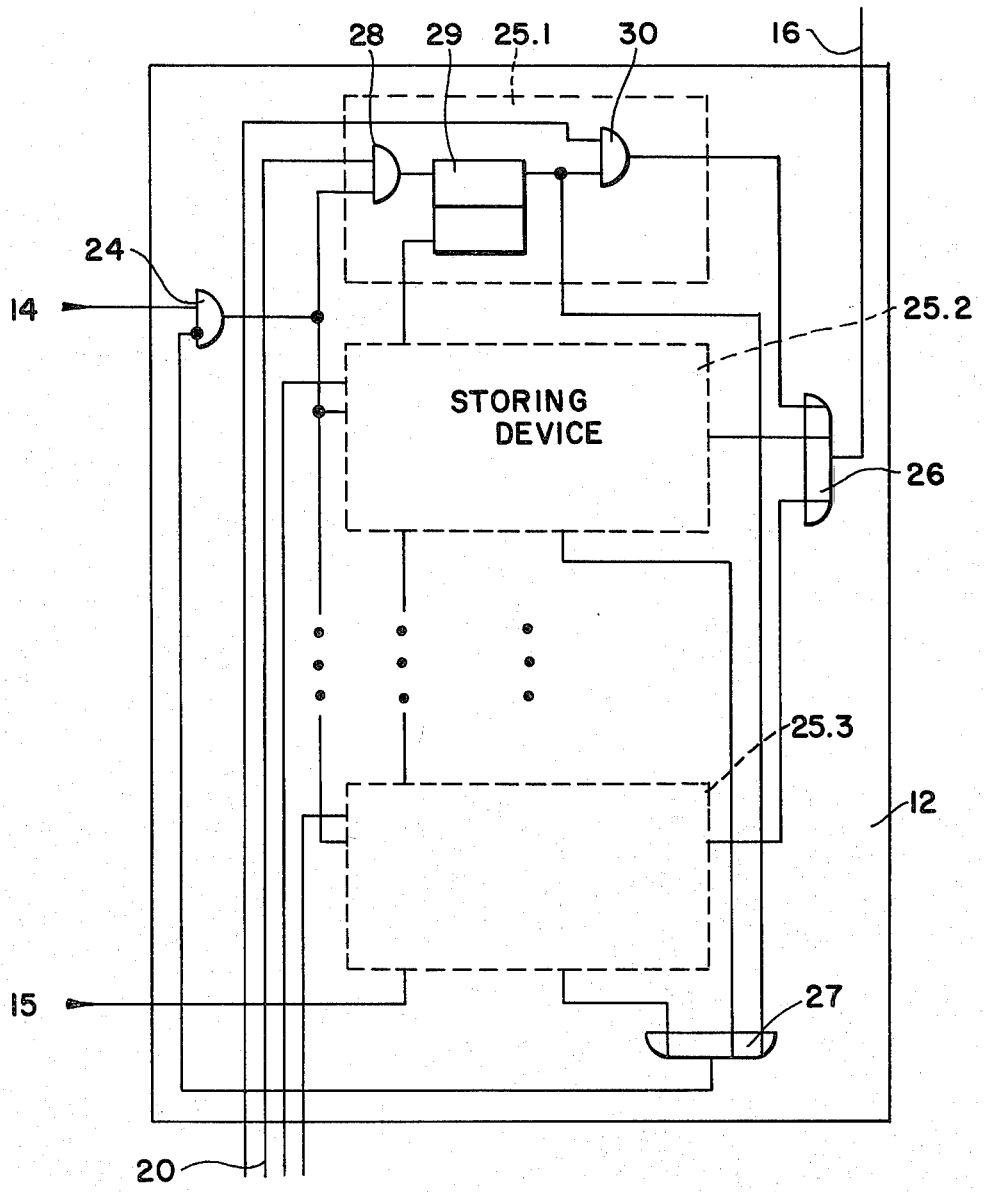
FIG. 3 is a schematic block diagram of a timing pulse adjuster in the circuit of FIG. 1.

A clock pulse adjusting circuit 12, illustrated in greater detail in FIG. 3, has a plurality of inputs connected to assigned outputs of a clock pulse generator 13. Both the timing pulse generator 12 and the timing pulse generator 13 are connected respectively to inputs of the auxiliary control circuit 7. One of the inputs of the time pulse adjuster 12 is connected to a machine stop device 15.

Referring now to FIG. 2, the illustrated auxiliary control circuit 7 includes two AND-gates 17 and 23, two NAND-gates 19 and 21, and two OR-gates 18 and 22. One input of each AND-gate and NAND-gate is connected in parallel and to the switching device 11. The other input of AND-gate 17 is connected via conduit 16 to the output of the timing pulse adjuster 12. The other input of NAND-gate 19 is connected via connector 20 to the output of timing pulse generator 13. The other input of NAND-gate 21 is connected to the data outputs of the first control circuit 1, and the other input of AND-gate 23 is connected to the sheet control device 14. The outputs of gates 17 and 19 are connected to corresponding inputs of the OR-gate 18, and the output of the latter is connected to the data input 9 of the second controlling circuit 3. Similarly, the outputs of gates 21 and 23 are connected to the input of OR-gate 22 and the output of the latter is connected to the clock pulse input 10 of the second controlling circuit 3.

The timing pulse adjuster 12 includes an AND-gate 24 having its negating input connected to the output of an OR-gate 27 and its other input connected to the sheet controlling device 14. The output of NAND-gate 24 is connected to parallel inputs of similar storing devices 25.1, 25.2, and 25.3. Each storing device includes a flip-flop store 29 having its input connected to the output of an AND-gate 28 and its output connected to an input of another AND-gate 30, on the one hand, and to an input of OR-gate 27 on the other hand. The output of AND-gate 30 is connected to a corresponding input of another OR-gate 26. The other inputs of AND-gates 28 are connected to the outputs of the timing pulse generator 13. A machine stop device 15 is connected to the resetting inputs of the storing devices 25.1 to 25.3.

The operation of the control system according to this invention is as follows:

In the first or face printing mode of operation of the machine the actuation of the groups of functional elements in the first printing unit is controlled by the first activating stage or circuit 2 which in turn is controlled by the first control circuit 1, the latter being controlled in a known manner according to signals applied to the clock pulse input 5 and the data input 6.

The data signal from the output 8 of the first control circuit 1 is applied, as mentioned before, to the input of NAND-gate 21. During the first printing mode of operation, the switching contact of the device 11 is open and consequently the conductive condition due to the signal negation is fulfilled on the NAND-gate 21 and a logic "1" is applied via the second OR-gate 22 to the second control circuit 3. AND-gate 23 due to the "0" signal at the switching device 11 is blocked.

The timing pulse adjuster 13 prepares a timing signal delivered from the time pulse generator 13 via conductor 20, for timing the activation of the groups of functional elements in the second printing unit during the first printing mode of operation. This timing signal may correspond, for example, to 130° of a cycle. This first printing timing signal is applied to the input of NAND-gate 19. Since the switching contact of device 11 remains open during the first printing operation, the conductive condition of the NAND-gate 19 is fulfilled, logic "1" is generated at its output and applied via OR-gate 18 to the second control circuit 3 for the following printing unit. AND-gate 17, however, is blocked. The actuation of the functional elements of the second printing unit is now controlled by the second interrogating stage 4, which in turn is controlled by the second control circuit 3. The control by means of circuit 3 is effected in known manner according to the signal condition on its inputs 9 and 10, which in turn is dependent on the signal condition on the output 8 in the first control circuit.

First (face) and first and second (back-up) mode of operation

When the printing machine is switched over to this mode of operation, the contact of the switching device 11 is closed and the sheet control device 14, when no sheet is present, delivers a logic "0" signal. The timing pulse generator 13 delivers, apart from the timing signal for the first printing applied to conductors 20, also a plurality of sequences of comparison clock pulses.

These comparison clock pulses cover the entire range of possible timing points, which may occur during changeover from the first printing to the first and second printing mode of operation for adjusting the time sequence of functional elements in the second printing unit. This range of timing points during the processing of sheets of a smallest format and sheets of a largest format, is between 150° and 270°, for example. For this purpose, the timing pulse generates 13 supplies comparison corresponding to 150°, 180°, 210°, 240° and 270°.

Of course, it is also possible to generate clock pulse signals at different rates corresponding to a nonperiodic division of each cycle. Each of the comparison clock pulse signals is applied to one of storing devices 25 in the timing pulse adjuster 12. In addition, a signal from the sheet control device 14 is applied to each storing device 25. The sheet control device 14 is fixedly arranged in the sheet-turning device between the two printing units and is adjusted simultaneously with the latter according to the sheet format to be processed. Accordingly, the sheet-turning device 14 delivers at a certain time point corresponding to a certain adjustment of the turning drum for the processed machines, a logic signal which is indicative of whether a sheet is present or missing on the drum. The logical signal corresponding to the missing sheet is applied to the input of the NAND-gate 24 in the timing pulse adjuster 12. Since the condition of conductivity of the NAND-gate 24 is fulfilled (storing devices 25 are not yet set), the signal is applied to the inputs of the individual storing devices 25.

Provided that the time point of the occurrence of the sheet-missing signal coincides with the comparison clock pulse applied to the storing device 25 via the conductor 20, the corresponding flip-flop 29 is set. As a result, the timing rate for adjusting the second control circuit to the first and second printing mode of operation, is fixed.

The stored timing pulse for the first and second printing mode of operation is released through conductor 16 to the auxiliary control circuit 7 in response to the timing pulse prepared by the timing pulse adjuster 12 due to the conductive condition of AND-gate 30.

A further comparison of clock pulses ceases when a flip-flop store 29 in one of the storing devices 25 is set, upon closing the NAND-gate 24. After stopping the printing machine, all flip-flop stores 29 are cleared, so that after reactivation of the printing machine a new comparison of timing pulses is necessary. The timing pulse adjusted to the format of processed sheets in the first and second printing mode of operation is applied to an input of AND-gate 17 in the auxiliary control circuit 7. Since in this mode of operation the contact of switching device 11 is closed, a logical "1" signal is present and the conductive condition of the gate 17 is fulfilled, and consequently the timing signal for the first and second printing mode of operation is applied via OR-gates 18 to the second control circuit 3 for the second printing unit. The NAND-gate 19 in the auxiliary control circuit 7, due to the closed contact in device 11, is blocked.

As soon as a sheet is detected by the sheet control device 14, a logic "1" is applied to the AND-gate 23 in circuit 7. Since contaxt 11 remains closed, the conductive condition for the gate 23 is fulfilled and a signal is applied via OR-gate 22 to the second control circuit 3. The conductive condition for the NAND-gate 21 is not fulfilled, and the latter is blocked.

The second interrogating stage 4 is now actuated in a known manner in response to the signals applied to the data input 9 and clock pulse input 10 from the auxiliary control circuit 7 and the functional groups of elements on the following printing unit are activated in concert with the requirements for the first and second printing operation.

It will be understood that each of the elements described above, or two or more together, may also find a useful application in other types of constructions differing from the types described above.

While the invention has been illustrated and described as embodied in a specific example of a control system for changing over printing conditions of a multicolor, sheet-fed, rotary printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control system for changing over a first printing mode of operation to first and second printing mode of operation in a multi-color, sheet-fed rotary printing machine including a plurality of consecutive printing units and a sheet-turning device between the printing units, said system comprising a first control circuit for controlling the operation of functional elements in a first printing unit, said first control circuit including a data input, a data output, a clock pulse input and a clock pulse output; an auxiliary control circuit having a plurality of inputs and two outputs, said clock pulse output of said first control circuit being connected to one input of the auxiliary control circuit; a switching device for delivering a logic control signal according to the selected mode of operation of the printing machine; a second control circuit having a data input and a clock pulse input connected respectively to said outputs of the auxiliary control circuit; a timing pulse generator having a plurality of outputs, one of said outputs being connected to an input of said auxiliary control circuit for delivering a comparison clock signal thereto; and timing pulse adjuster connected between the outputs of said timing pulse generator and said auxiliary control circuit; a sheet-control circuit arranged on said sheet-turning device to deliver a signal corresponding to the presence or absence of a sheet, said signal being applied to said auxiliary control circuit and to said timing pulse adjuster.

2. A control system as defined in claim 1, wherein said auxiliary control circuit includes two AND-gates, two NAND-gates and two OR-gates, each of said gates having two inputs and an output, and one of the inputs of each NAND-gate being a negating input, the negating inputs of said NAND-gates being connected parallel to one input of each AND-gate and to said switching device, the other input of one AND-gate being connected to the output of said timing pulse generator, the other input of one NAND-gate being connected to an output of said timing pulse generator, and the output of said one AND-gate and said one NAND-gate being connected through one OR-gate to data input of said second control circuit; the other input of the other NAND-gate being connected to the clock pulse input of said first control circuit, and the other input of the other AND-gate being connected to said sheet-control device; and the output of said other NAND-gate and said other AND-gate being connected through the other OR-gate to the clock pulse input of said second controlling circuit.

3. A control system as defined in claim 2, wherein said timing pulse adjuster includes a NAND-gate and two OR-gates and a plurality of similar storing devices each including two AND-gates and a flip-flop storing circuit and, within said timing pulse adjuster, each of said AND- and NAND-gates having two inputs and an output, each OR-gate having an output and as many inputs as many storing devices are present, one of the inputs of said NAND-gate being a negating input connected to the output of one OR-gate and the other input of said NAND-gate being connected to said sheet control device; the output of said NAND-gate being connected in parallel to one input of one AND-gate in each storing devices whereas the other input of said one AND-gate in each storing being connected to a corresponding output of said time pulse generator, the output of said one AND-gate being connected to a setting input of said flip-flop storing circuit whereas a resetting input of each flip-flop storing circuit is connected to a machine stop device; the output of the flip-flop storing circuit in each storing device being connected to a corresponding input of said one OR-gate and to one input of the other AND-gate in each storing device, whereas the other input of each other AND-gate being connected to a corresponding output of said timing pulse generator, and the output of the other AND-gate being connected to a corresponding input of the other OR-gate; and the output of the other OR-gate being connected to said other input of said one AND-gate in said auxiliary control circuit.

* * * * *